US011266258B1

(12) United States Patent
Moon

(10) Patent No.: US 11,266,258 B1
(45) Date of Patent: Mar. 8, 2022

(54) STEMWARE RESTRAINT AND TABLETOP WEIGHT

(71) Applicant: Kevin Loren Moon, Vancouver, WA (US)

(72) Inventor: Kevin Loren Moon, Vancouver, WA (US)

( * ) Notice: Subject to any disclaimer, the term of this patent is extended or adjusted under 35 U.S.C. 154(b) by 0 days.

(21) Appl. No.: 16/672,304

(22) Filed: Nov. 1, 2019

(51) Int. Cl.
*A47G 23/02* (2006.01)

(52) U.S. Cl.
CPC ..... *A47G 23/0225* (2013.01); *A47G 23/0208* (2013.01)

(58) Field of Classification Search
CPC ..... A47G 23/0225; A47G 23/0208
USPC ..... 248/505, 346.11, 346.1
See application file for complete search history.

(56) References Cited

U.S. PATENT DOCUMENTS 1,925,540 A * 9/1933 Neuschotz ..... A47G 23/0208 248/313
2,006,238 A * 6/1935 Florman ..... A47G 23/032 215/394
8,132,770 B2 3/2012 Nargi
8,840,078 B2 * 9/2014 DeWald ..... B60N 3/103 248/311.2
D751,347 S 3/2016 DeWald
9,655,462 B2 * 5/2017 Cook ..... B60N 3/101
2004/0129701 A1 * 7/2004 Mahawili ..... A47G 19/06 220/23.8
2006/0169656 A1 * 8/2006 Belden ..... A47G 23/0208 211/84
2007/0131834 A1 6/2007 Reid
2010/0102065 A1 * 4/2010 Phelan ..... B63B 1/041 220/560
2013/0062494 A1 * 3/2013 Cecil ..... A47G 23/03 248/346.11
2016/0029803 A1 * 2/2016 Haenga ..... F16M 13/022 248/205.2
2017/0027357 A1 2/2017 Dodd

* cited by examiner

*Primary Examiner* — Muhammad Ijaz

(57) ABSTRACT

A stemware restraining device that rests upon a surface and comprises a body with a top surface, bottom surface, a thickness, and a combination stem clearance slot (20,25,30,31) and underside cavity (21,27). Stemware can be slid into the slot cavity combination trapping said stemware's base while allowing the stem to pass vertically upward. The device does not necessarily contact the stemware until said stemware tips due to an external force. When this occurs the base of the stemware comes into contact with the underside cavity of said device and is restrained due to the resistive tipping moment of the device. The resistive tipping moment is provided either by the weight and width of said device or by its mechanical or magnetic attachment to said surface. The slot and cavity combination in general reflects the profile shape of the base and stem of a piece of stemware.

3 Claims, 16 Drawing Sheets

STEMWARE RESTRAINT AND TABLETOP WEIGHT

CROSS REFERENCE TO RELATED APPLICATIONS

This application claims the benefit of provisional patent Application No 62/756,026, Confirmation Number 6114, filed Nov. 5, 2018 by the present inventor

FEDERALLY SPONSORED RESEARCH

None

SEQUENCE LISTING

None

BACKGROUND

This relates to a device designed to keep stemware from tipping or falling over. Stemware (wineglasses, champagne glasses, some water glasses, etc) is unstable compared to other forms of glassware such as most cups, highball glasses, etc. This is because it has a narrow foot (in some cases as defined by ISO Standard ISO 3591:1977, Sensory-Analysis-Apparatus-Wine-Tasting Glass) with a bowl mounted on top of a stem. This means stemware has a high center of gravity and a low resistive moment to tipping. This effect is compounded by wind, a non-level or non-stable tabletop or resting surface, or by the rocking on a boat/train/airplane. Further increasing the tendency for stemware to fall over is the fact that the cross section of the bowl presents itself as a sail and the center of effort presents itself as roughly halfway up the bowl. This means a relatively small breeze can tip over a full, partially full, or empty glass. Stemware is often used in the consumption of wine and a glass of wine can be a relatively large investment if the wine is of high value, spilled wine can destroy clothing, and broken glass is a danger.

Across time numerous people have tried to solve this problem with all types of devices. Recently a patent was issued for a Stemware Stabilizer U.S. Pat. No. 9,801,484B2 to Dodd which is a device that slides over the stem of a glass and then applies pressure to the base and stem in order to prevent the glass from tipping. It is essentially a weight placed on the base of the stemware in order to move the center of gravity of said stemware downward along the stem axis. This approach requires that the user remove the device every time they want to drink, otherwise said device will add undesirable weight to the stemware and/or it will slide up the stem as the user drinks potentially injuring the user and/or damaging the stemware. It is also asymmetrical which means that as the glass is tilted to drink it can rotate about the stem axis and fall off. The claims in the above patent show that it has a stem support that holds the stem of the glass as well as a body that applies downward pressure to the base of said stemware. This transfers the majority of stress to the stem increasing the chances of breaking the stemware. As the device shown here demonstrates (FIG. 1), the stem support is unnecessary. The effectiveness of a stem support is also highly affected by the variability in the shape of the base and stem of said stemware. While ISO Standard ISO 3591:1977, Sensory-Analysis-Apparatus-Wine-Tasting Glass defines the diameter of the base and stem (but not the radius of curvature as the base transitions into the stem) the vast majority of stemware does not comply with this ISO standard and there is a near infinite variety to the dimensions of stemware stems and bases. As a result stemware shows large variability in the shape of the base, the shape of the stem, and the shape of the base to stem transition. This variability should be accounted for in the design of a stemware restraining device.

Other people across time have proposed numerous solutions to this problem that range from devices that attach to the edge of a table to wires that embed in the ground and have a loop that holds the bottom of the bowl. None of these devices seem to have taken hold in the marketplace.

SUMMARY

A device for holding stemware stable as it sits on a table, the ground, or any other surface. Said device is a unitary structure comprised of a top surface, a bottom surface, sides, a thickness, one or more stem clearance slots in the top surface and a cavity on the underside that connects to said stem clearance slot. The underside cavity is generally but not necessarily symmetrical about both the horizontal and vertical centerlines of said stem clearance slot. The stem clearance slot and cavity combination (hereafter referred to as the stem clearance slot/cavity combination) are shaped such that the stemware can be inserted partially or completely into the body of said device. Said cavity provides a set of restraining points on the stemware base so that as the stemware tips it is restrained by said device providing a downward force against the stemware base thereby resisting the tipping moment of the glass. The stem clearance slot in said device may be curved or notched to prevent said stemware from sliding along the central horizontal slot axis if driven in that direction (experiments have shown that on low friction surfaces such as a metal tabletop stemware will slide). The width or weight of said device may be modified to change the resistive tipping moment (the wider or heavier the device the more it resists tipping) to account for variables such as wind, surface conditions, or the size of said stemware. Said device may also attach to the surface it is placed upon using magnets or mechanical means. It may also have contacting feet, pads, brushes, etc. on the underside of said cavity that provide downforce to the stemware base.

Accordingly, said device offers a number of advantages over existing devices. It is not required to be placed onto or attached to the stemware in any way, the stemware simply has to be slid into the stem clearance slot/cavity combination in the device in order to be restrained. It allows for variability in stemware shape and does not overly restrain said stemware. By creating downward force predominantly on the stemware base it uses the lowest possible force required to restrain said stemware which results in reduced stress in the base and stem and therefore reduced potential for breakage. It can hold other tabletop accessories or additional objects securely in recesses or protuberances formed into the top surface, and the shape of said slot can be modified in order to place additional restraint on the stemware as required. Said device can be made such that it has a plurality of stem clearance slot/cavity combinations in one device in order to hold more than one piece of stemware. Said device can also have a recess in the top that holds highball glasses or protuberances on the top that restrain a standard pint drinking glass. An added benefit is that said device can be used as a table top weight to hold napkins, placemats, and tabletop accessories in place in a windy or unstable environment. It can be made out of numerous materials including but not limited to glass, plastic, metal, stone, ceramic, concrete, resin, wood, etc.

In summary, this device is a unitary structure that stops stemware from tipping or falling over and that is easy to use, responds to the variability in stemware dimensions, can be made out of numerous materials, and which rests on a tabletop, the ground, or any other surface. Said device can also provide additional tabletop services such as holding salt and pepper shakers, electronics, napkins, etc. In addition, said device can have multiple slots and cavities in order to hold more that one piece of stemware at a time. Previous devices involve attachment and removal from said stemware, protrude from the table edge, or need to be embedded in the ground.

DRAWINGS

DETAILED DESCRIPTION

Figure 1:
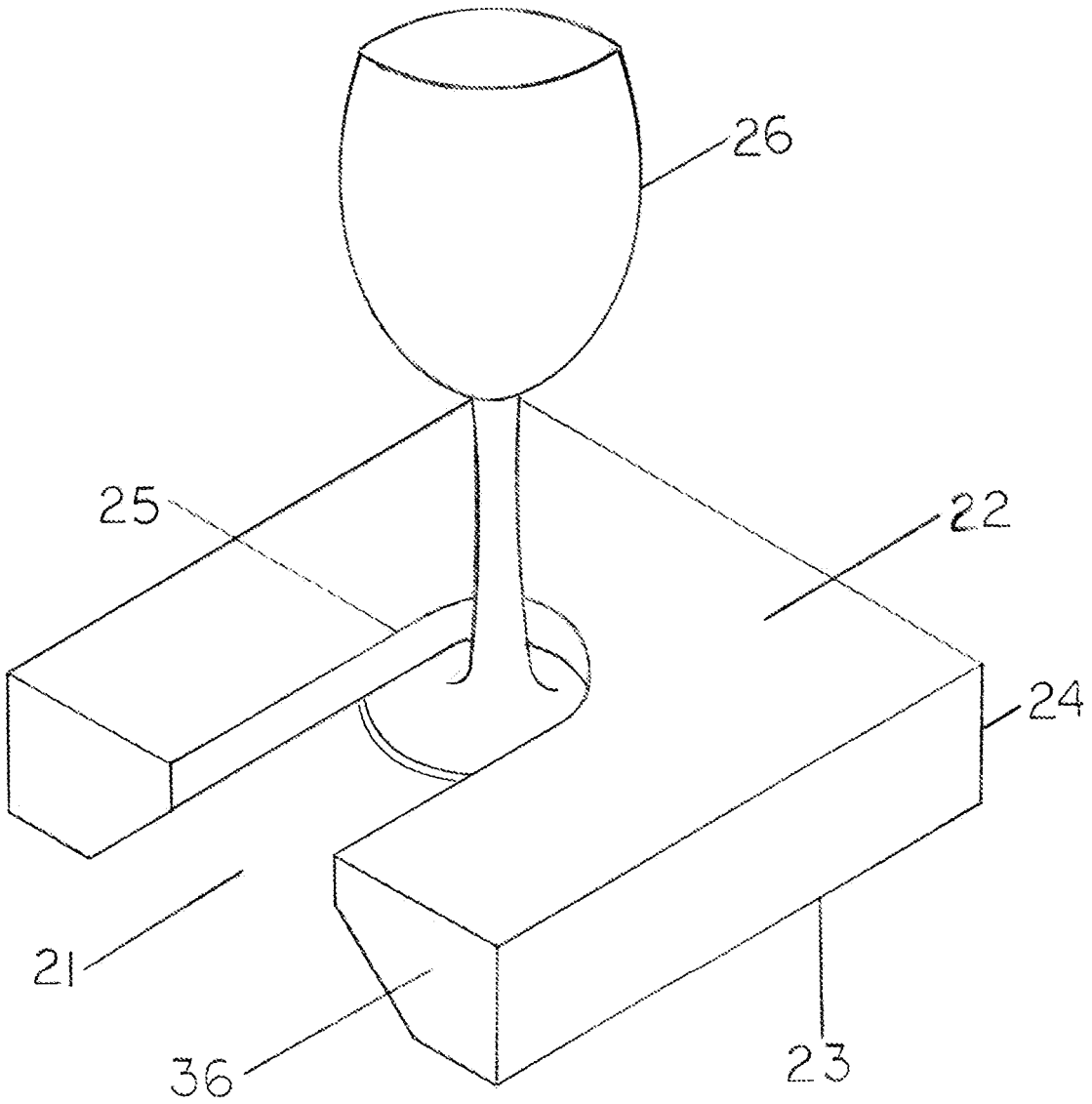
FIG. 1 illustrates a perspective right side view of the Stemware Restraint and Tabletop Weight in use with an item of stemware installed in said device.

The following is a detailed description of the embodiments presented in the drawings. These embodiments are not intended to limit the scope of the claimed invention and are provided only as examples. The shape of the exterior, the details of the stemware clearance slot/cavity combination, and additional functional details can be varied to meet the required design parameters. Other embodiments could include but not be limited to the following features: mechanical latches that hold the stemware in place, cushioning pads, liners, brushes, or springs inside the cavity that provide downward force to the base of said stemware, etc.

FIG. 1 is a perspective right side upper view of an embodiment of the Stemware Restraint and Tabletop Weight in accordance with the invention that shows it with a wide stem clearance slot 25 connected to underside cavity 21. It has a top surface 22, a bottom surface 23, a thickness 24, and a front face 36. Stemware 26 is inserted into said wide stem clearance slot 25/cavity 21 combination. This is an example of the Stemware Restraint and Tabletop Weight in use. It can be seen from this drawing that there is no need for a stem support in order for said device to perform its function.

Figure 2:
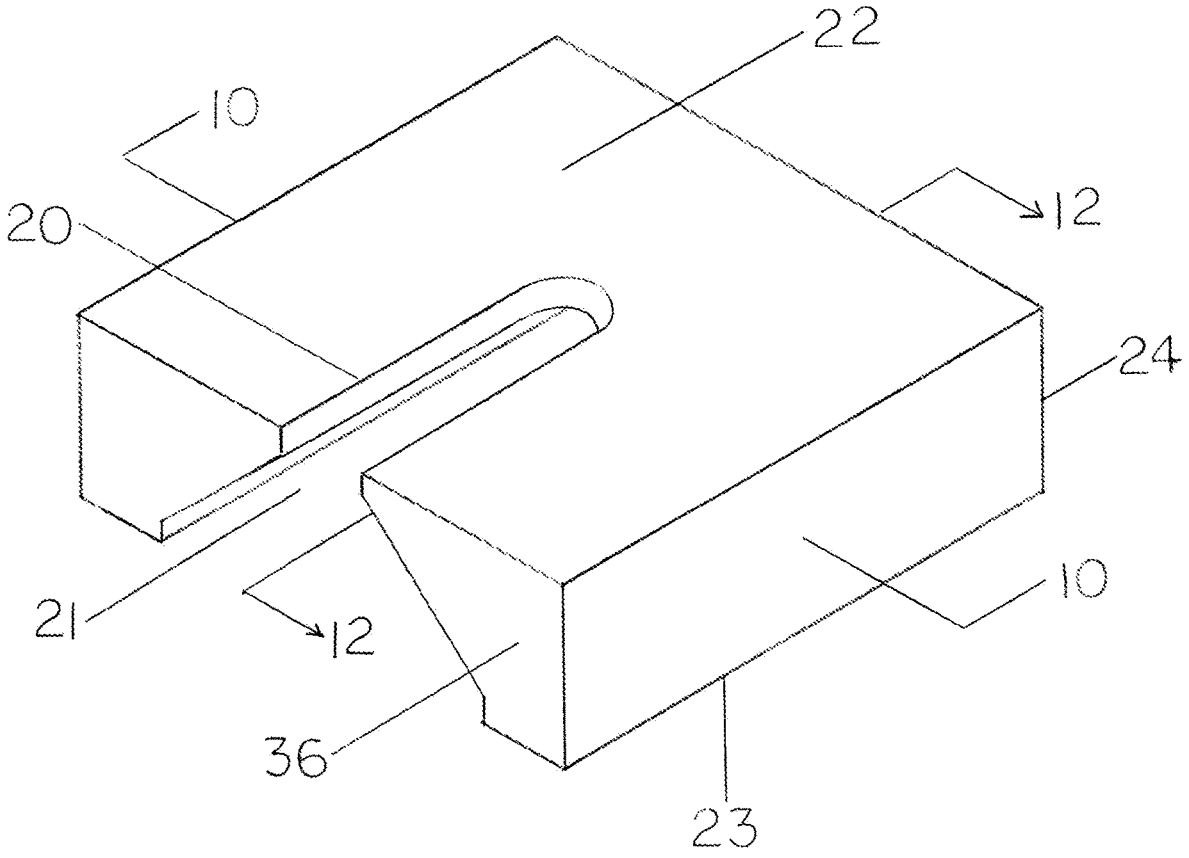
FIG. 2 is a perspective right side upper view of the Stemware Restraint and Tabletop Weight in one embodiment.

FIG. 2 is a perspective right side upper view of an embodiment of the Stemware Restraint and Tabletop Weight in accordance with the invention that shows it with a straight stem clearance slot 20 connected to an underside cavity 21. The stem clearance slot 20/cavity 21 combination follow a linear centerline of the device, said centerline being determined by a horizontal line perpendicular to face 36 and beginning at the midpoint of said face.

Figure 3A:
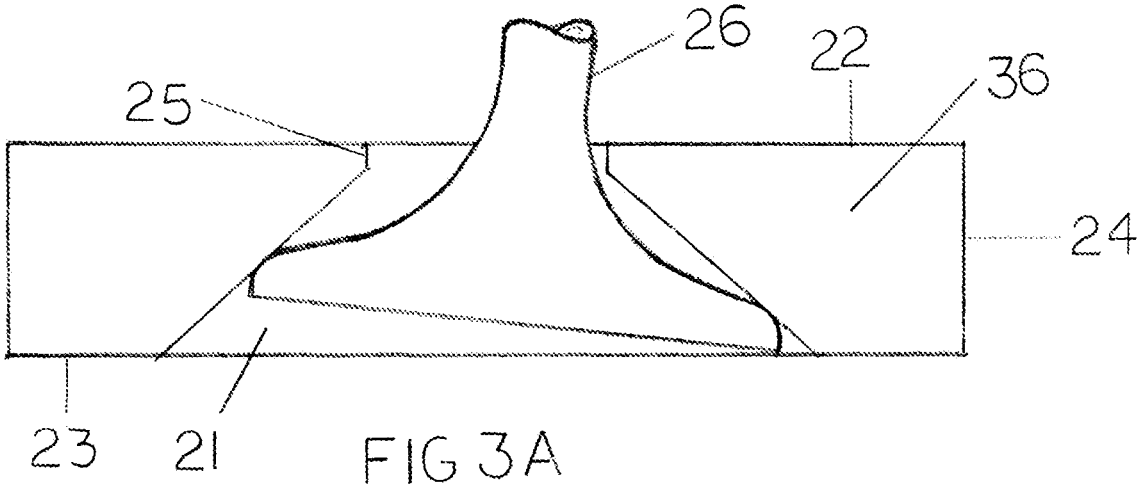
FIG. 3A illustrates looking down the stem clearance slot/cavity combination horizontal axis of an embodiment of the Stemware Restraint and Tabletop Weight with a stemware base in the tipped position.
Figure 3B:
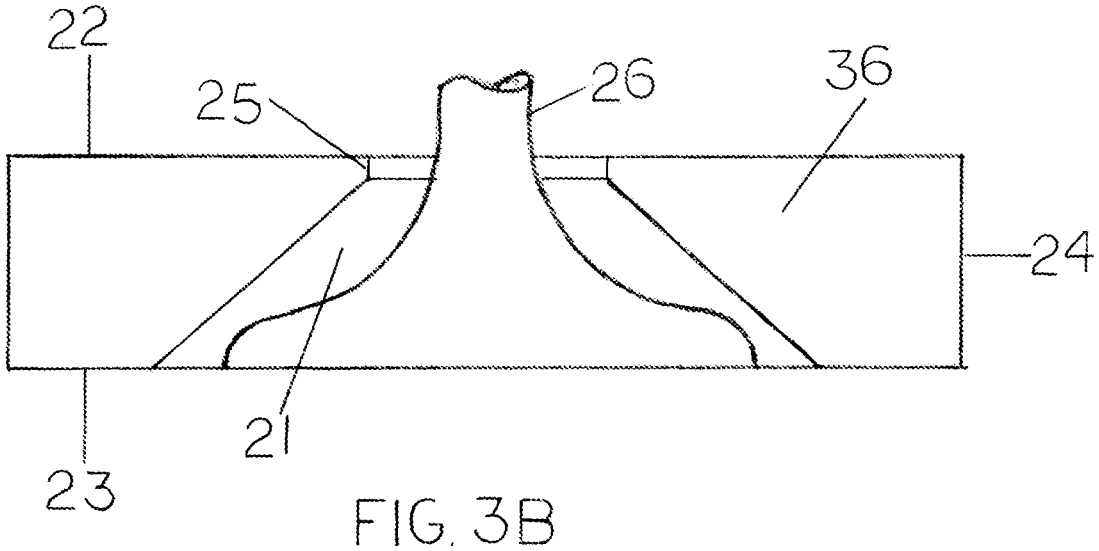
FIG. 3B illustrates looking down the stem clearance slot/cavity combination horizontal axis of an embodiment of the Stemware Restraint and Tabletop Weight with a stemware base in the upright position.

FIG. 3A and FIG. 3B show side views of an embodiment of the Stemware Restraint and Tabletop Weight in accordance with the invention viewed perpendicular to front face 36 with stemware 26 installed in a wide stem clearance slot 25/cavity 21 combination. In FIG. 3A said stemware 26 is tipped and restrained by the device and in FIG. 3B said stemware 26 is standing flat on the surface. It can again be seen that said stemware 26 does not need any support on the stem in order to be restrained and that during normal (non-tipping) usage said stemware 26 does not necessarily contact the device, reducing wear and tear on said stemware and making insertion and removal into the wide stem clearance slot 25/cavity 21 combination easier.

Figure 4:
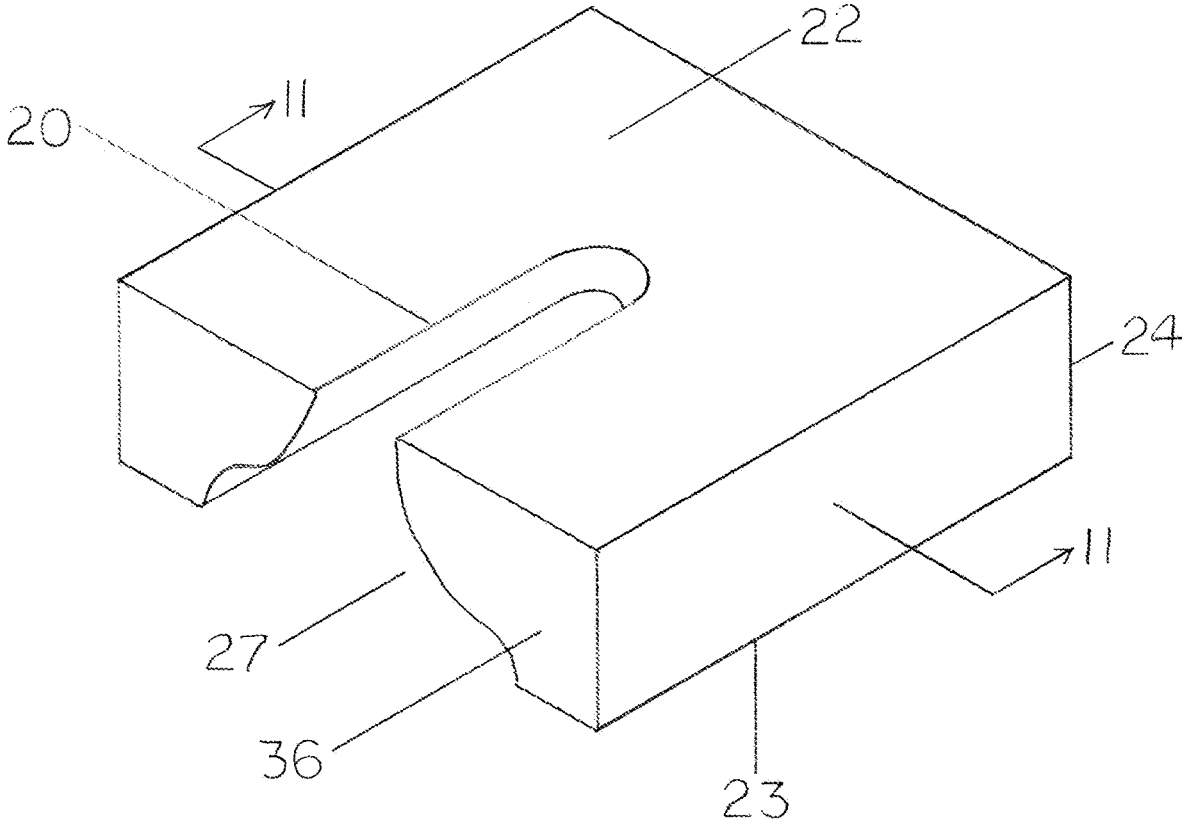
FIG. 4 is a perspective right side upper view of the Stemware Restraint and Tabletop Weight in another embodiment.

FIG. 4 is a perspective right side upper view of an embodiment of the Stemware Restraint and Tabletop Weight in accordance with the invention that shows it with a straight centered stem clearance slot 20/sculpted cavity 27 combination. Sculpted cavity 27 is shaped to reflect the profile of a stemware base. This shape can be customized for specific stemware base shapes or designed to work with generic stemware designs. This embodiment suggests to the user that the stemware 26 should be placed into the stem clearance slot 20/sculpted cavity 27 combination due to the similar shapes of the items. It also could be viewed as having a more pleasing aesthetic appearance. In this embodiment the stem clearance slot 20/sculpted cavity 27 combination follow the centerline of the device, said centerline being determined in this embodiment by a horizontal line perpendicular to face 36 and beginning at the midpoint of said face.

Figure 5:
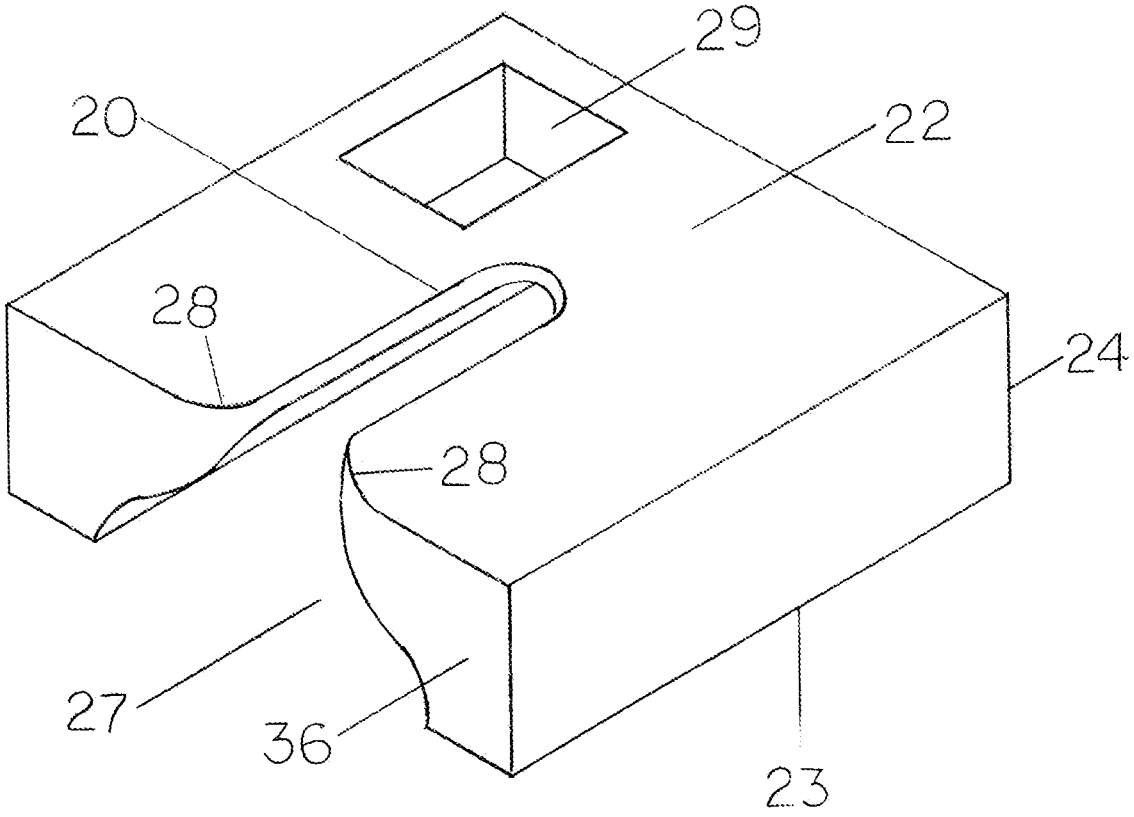
FIG. 5 is a perspective right side upper view of the Stemware Restraint and Tabletop Weight in another embodiment.

FIG. 5 is a perspective right upper side view of an embodiment of the Stemware Restraint and Tabletop Weight in accordance with the invention with a stem clearance slot 20 and sculpted cavity 27 that reflects the profile of a stemware base, a radiused point of entry 28 for the slot 20, and an upper cavity 29 on the top surface 22 indicative of that which might be used to hold tabletop accessories (salt and pepper shakers, etc.) In this embodiment the radiused slot entry 28 further enables ease of use of said device by guiding said stemware 26 into the stem clearance slot 20/sculpted cavity 27 combination.

Figure 6:
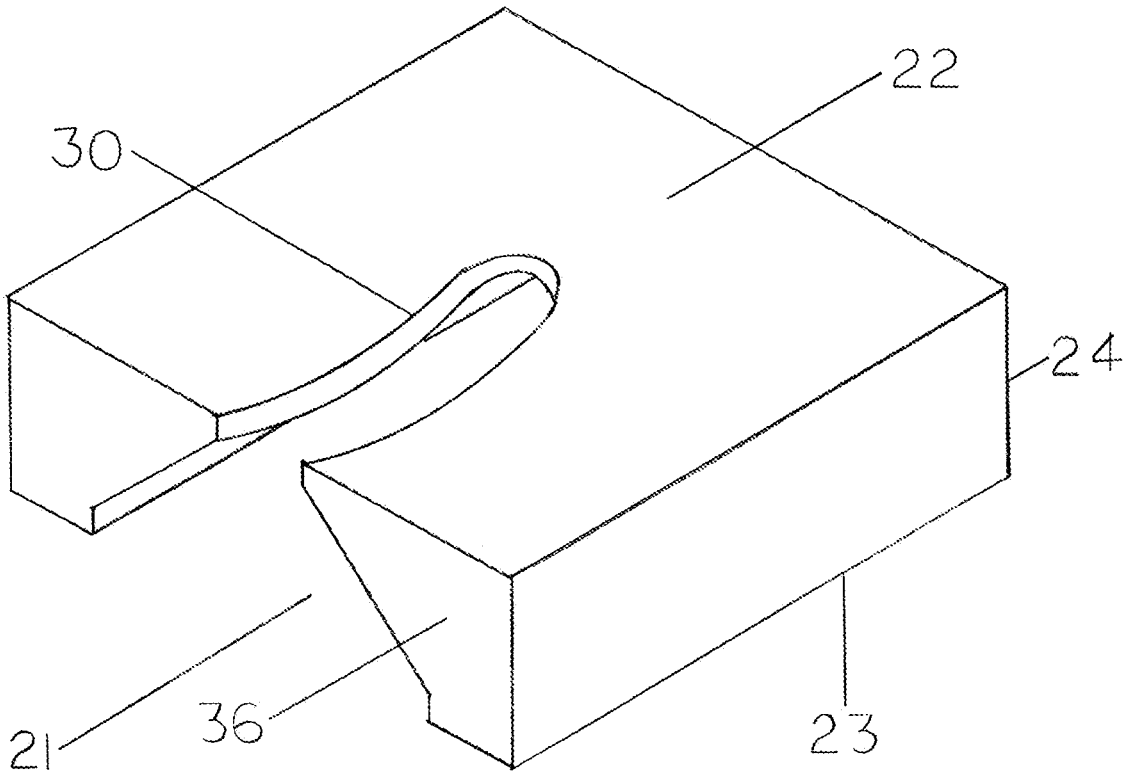
FIG. 6 is a perspective right side upper view of the Stemware Restraint and Tabletop Weight in another embodiment.

FIG. 6 is a perspective right side upper view of an embodiment of the Stemware Restraint and Tabletop Weight in accordance with the invention that shows it with a curved stem clearance slot 30 and a cavity 21. In this embodiment the curved stem clearance slot 30 adds additional resistance to said stemware tipping by restraining it along the slot 30 central axis. Testing has shown that on smooth surfaces stemware 26 can slide along the horizontal centerline axis of a straight slot 20.

Figure 7:
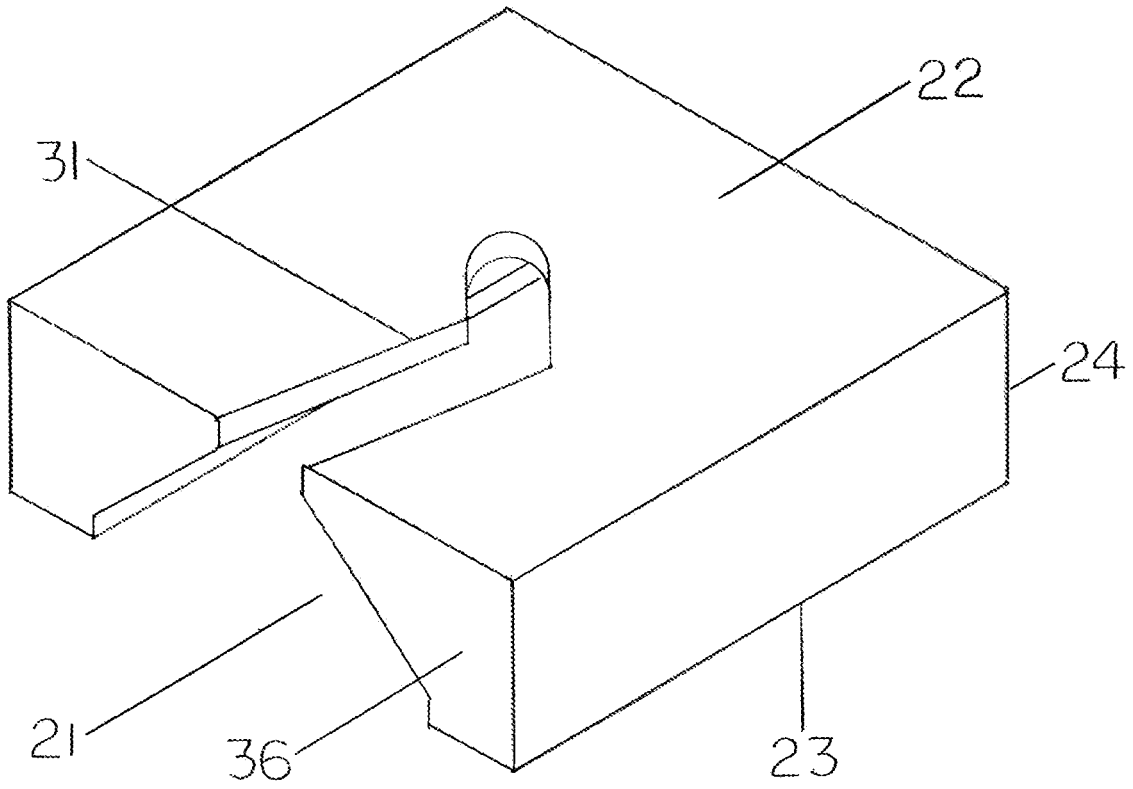
FIG. 7 is a perspective right side upper view of the Stemware Restraint and Tabletop Weight in another embodiment.

FIG. 7 is a perspective right side upper view of an embodiment of the Stemware Restraint and Tabletop Weight in accordance with the invention that shows it with a non-linear stem clearance slot 31 connected to a cavity 21. In this embodiment the non-linear stem clearance slot 31 adds additional resistance to said stemware 26 tipping by adding an angled bend along the non-linear stem clearance slot 31 horizontal centerline axis. In this embodiment as the stemware 26 begins to move along the non-linear stem clearance slot 31 axis due to the actions of an external force said stemware encounters the sides of said non-linear stem clearance slot 31 and stops moving due to the resisting force provided by the sides of said stem clearance slot. Testing has shown that on low friction surfaces stemware can slide along the horizontal axis of a straight stem clearance slot. In this embodiment the slot profile looking downward perpendicular to the top surface can be curved or linear and the hook can take many shapes and be located in any position along said non-linear stem clearance slot 31 horizontal centerline axis.

Figure 8:
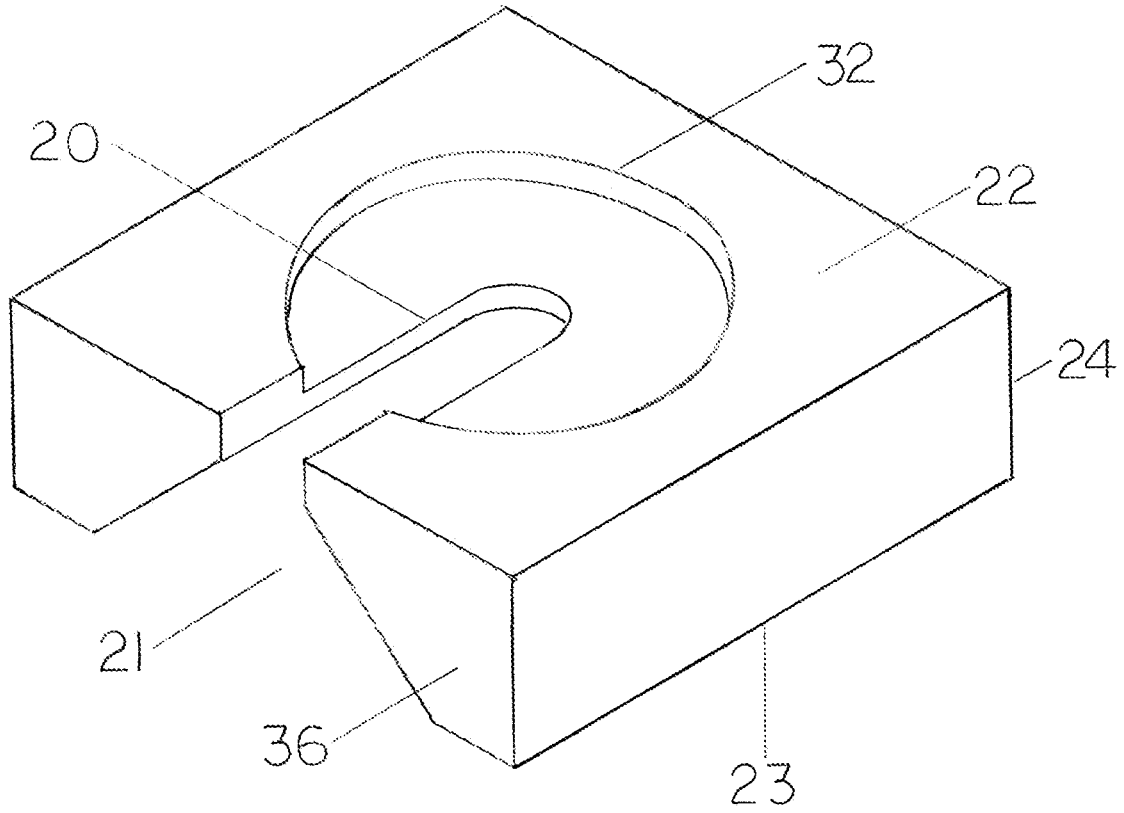
FIG. 8 is a perspective right side upper view of the Stemware Restraint and Tabletop Weight in another embodiment.

FIG. 8 is a perspective right side upper view of an embodiment of the Stemware Restraint and Tabletop Weight in accordance with the invention that shows it with a highball glass recess 32 in the top of said Stemware Restraint. Said recess increases the functionality of the device by allowing it to act as a coaster as well as providing restraint to another type of drinking vessel.

Figure 9:
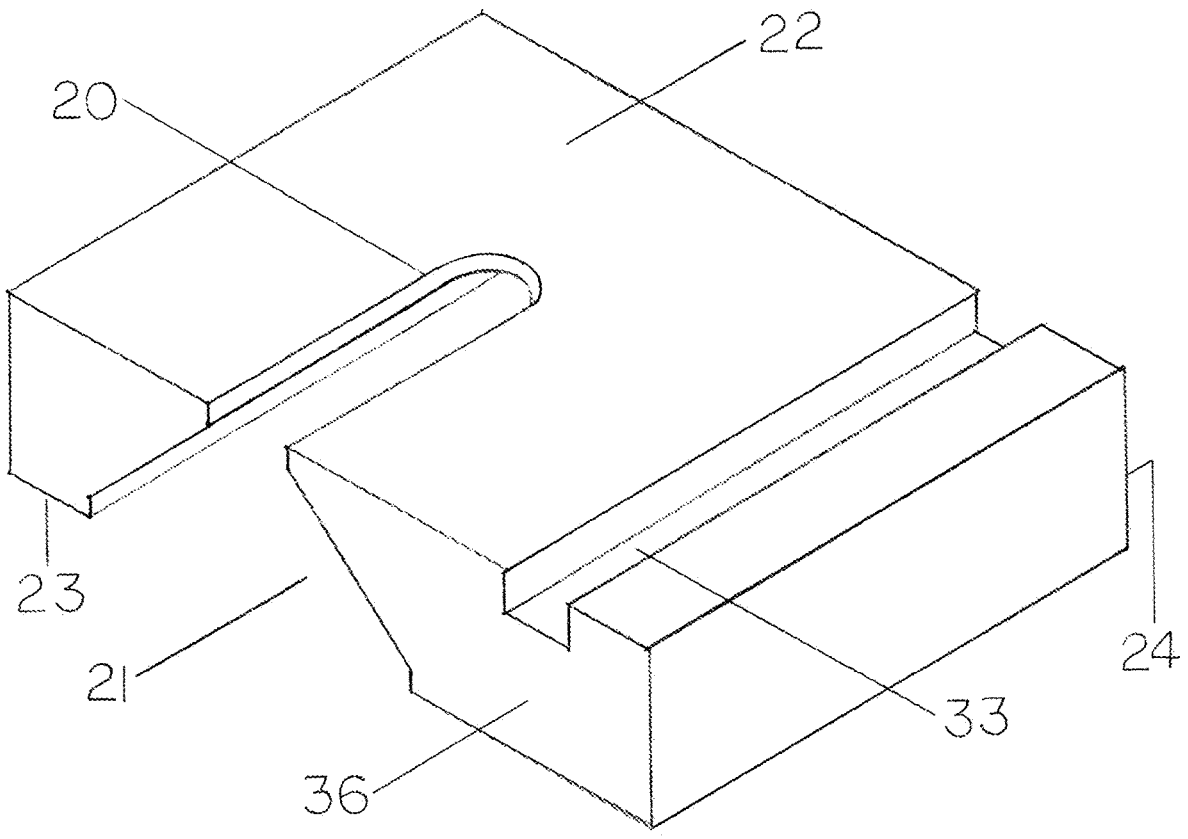
FIG. 9 is a perspective right side upper view of the Stemware Restraint and Tabletop Weight in another embodiment.

FIG. 9 is a perspective right side upper view of an embodiment of the Stemware Restraint and Tabletop Weight in accordance with the invention with a stem clearance slot 20 and cavity 21. FIG. 9 shows said device with an additional slot 33 in top surface 22. Slot 33 is sized to hold a phone, electronic pad, or book. This increases the functionality of the device by allowing it to act as a phone/book/magazine etc. stand.

Figure 10:
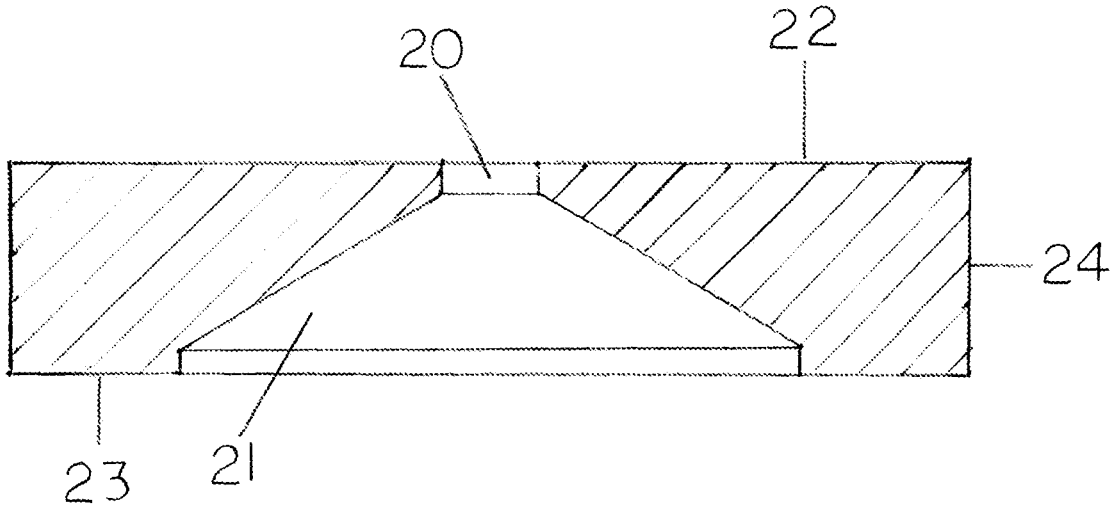
FIG. 10 illustrates a sectional view of an embodiment of Stemware Restraint and Tabletop Weight.

FIG. 10 shows a cross sectional view of the Stemware Restraint and Tabletop Weight from FIG. 2 with a stem clearance slot 20/cavity 21 combination.

Figure 11:
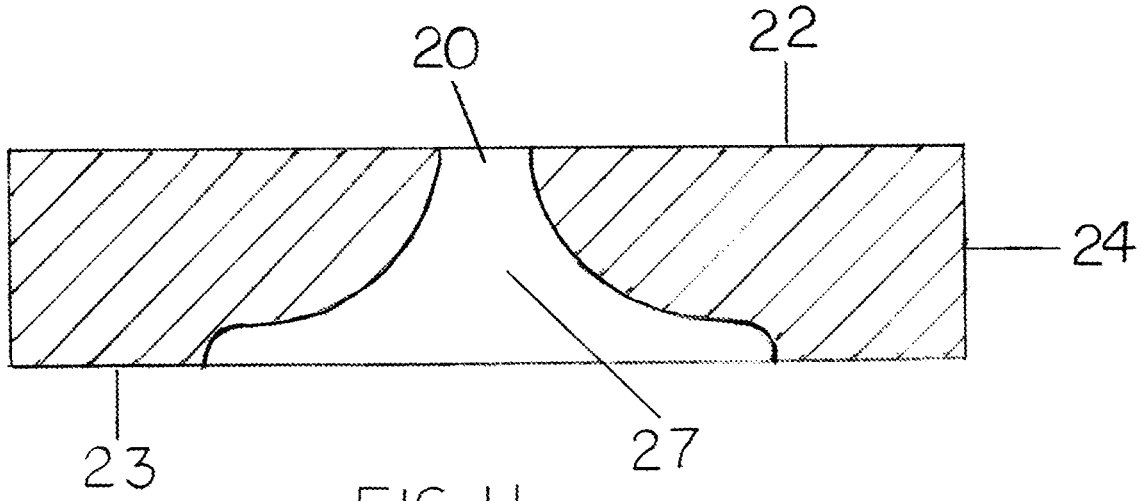
FIG. 11 illustrates a sectional view of an embodiment of Stemware Restraint and Tabletop Weight.

FIG. 11 is a cross sectional view of the Stemware Restraint and Tabletop Weight from FIG. 4 with a stem clearance slot 20/sculpted cavity 27 combination.

Figure 12:
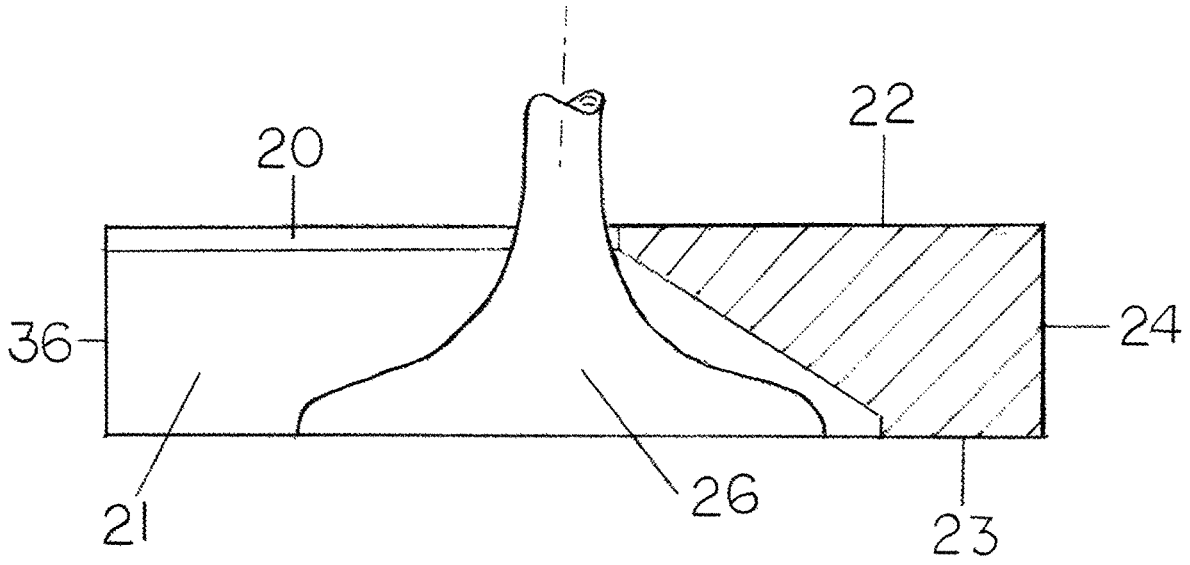
FIG. 12 illustrates a sectional view of an embodiment of Stemware Restraint and Tabletop Weight with a stemware base installed.

FIG. 12 is a cross sectional view of Stemware Restraint and Tabletop Weight from FIG. 2 with a stem clearance slot 20/cavity 21 combination, and stemware 26 installed in the fully seated position.

Figure 13:
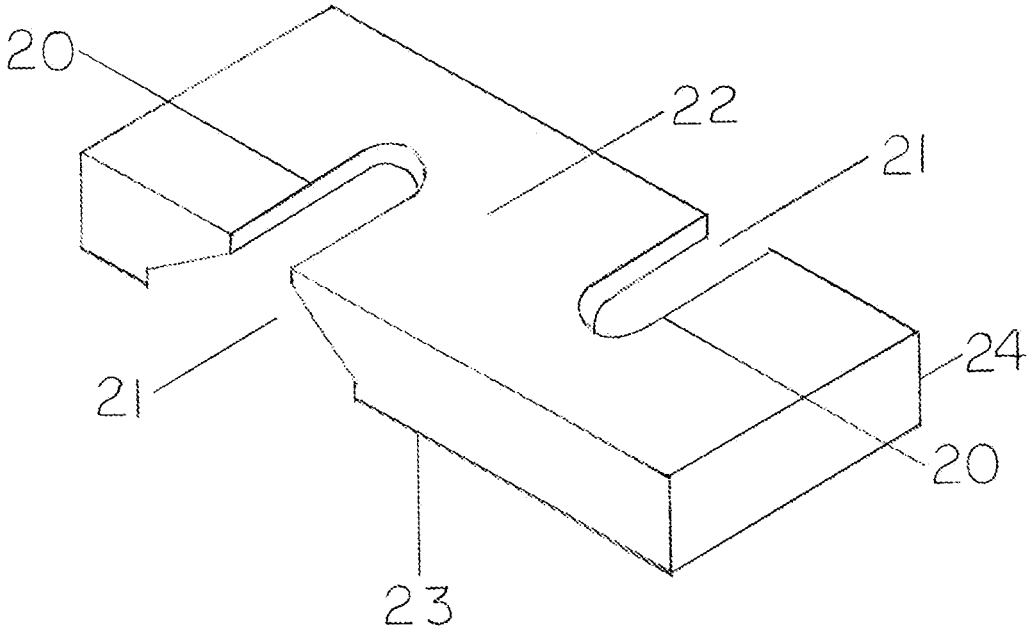
FIG. 13 is a perspective right side upper view of the Stemware Restraint and Tabletop Weight in another embodiment.

FIG. 13 is a perspective right side upper view of an embodiment of the Stemware Restraint and Tabletop Weight in accordance with the invention that shows it with two stem clearance slots 20 and two cavities 21. This embodiment shows that multiple items of stemware can be held by a single device, thereby increasing its usefulness.

Figure 14:
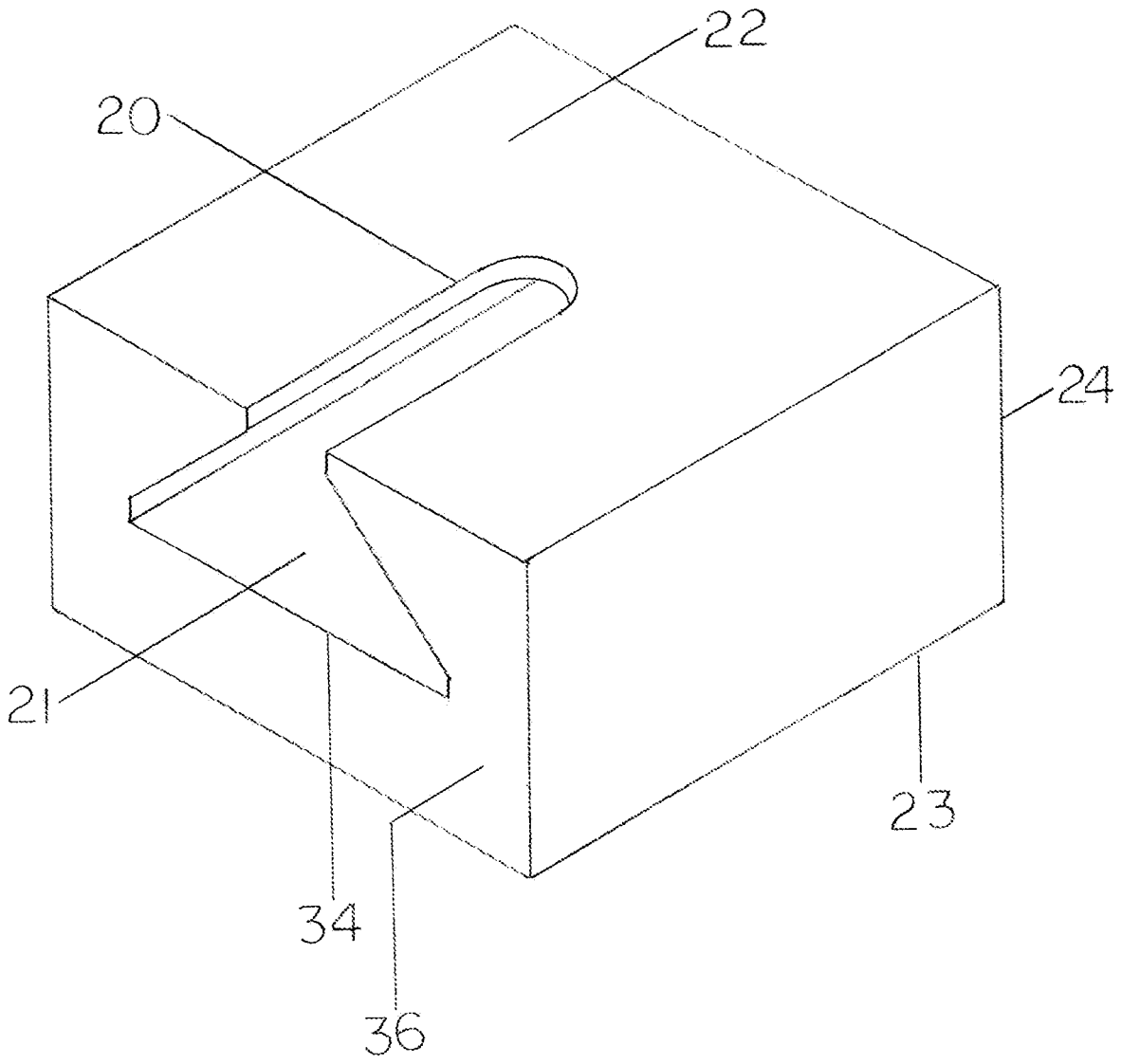
FIG. 14 is a perspective right side upper view of the Stemware Restraint and Tabletop Weight in another embodiment.

FIG. 14 is a perspective right side upper view of an embodiment of the Stemware Restraint and Tabletop Weight in accordance with the invention that shows it with a stem clearance slot 20/cavity 21 combination, and a thickness 24. In this embodiment said device has a solid bottom 34 such that the stemware rests inside cavity 21 on bottom 34. This embodiment increases the usefulness of said device by improving its functionality on uneven surfaces.

Figure 15:
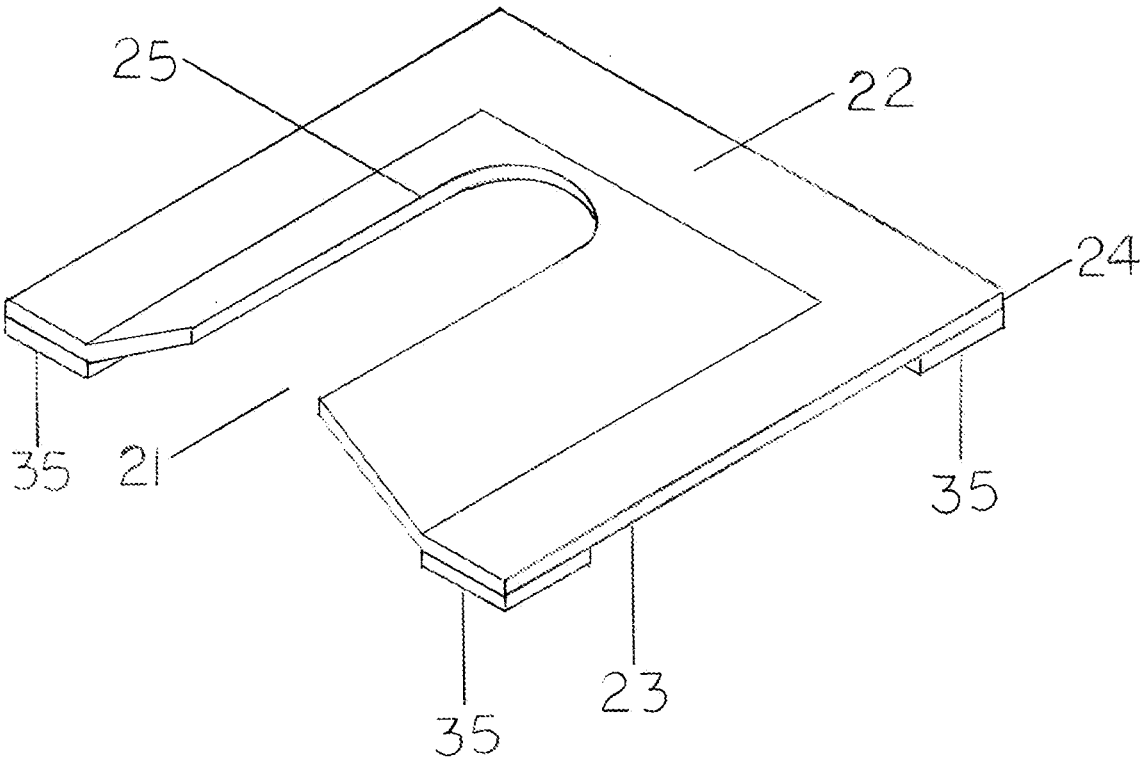
FIG. 15 is a perspective right side upper view of the Stemware Restraint and Tabletop Weight in another embodiment.

FIG. 15 is a perspective right side upper view of an embodiment of the Stemware Restraint and Tabletop Weight in accordance with the invention that shows it with a wide stem clearance slot 25/cavity 21 combination, and a thickness 24. In this embodiment said device also includes feet 35 that may or may not attach to the surface upon which the device rests via magnetic or mechanical means or which are weighted to increase the resistive tipping moment. Thickness 24 is reduced in this embodiment to indicate that said device can be functional with minimal thickness and weight.

Figure 16:
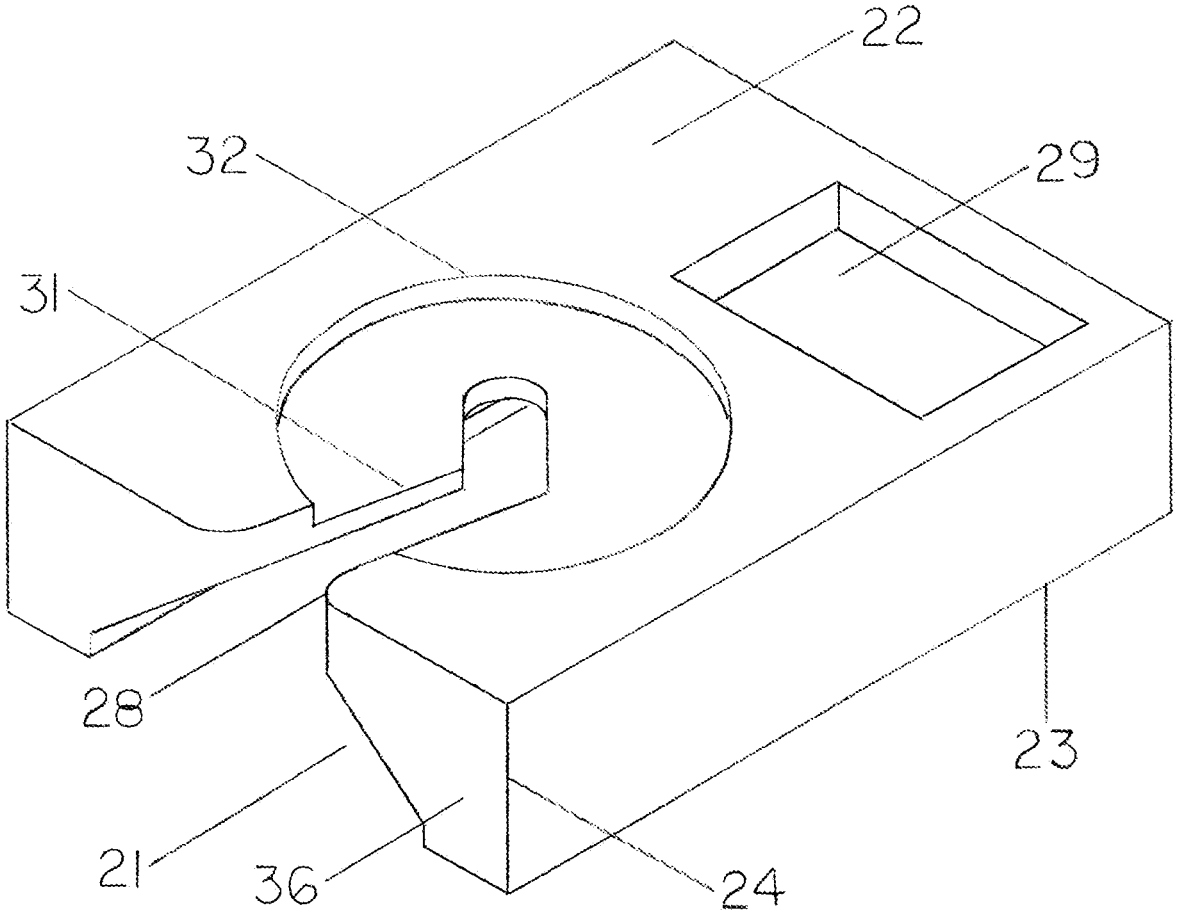
FIG. 16 is a perspective right side upper view of the Stemware Restraint and Tabletop Weight in another embodiment.

FIG. 16 is a perspective right upper side view of an embodiment of the Stemware Restraint and Tabletop Weight in accordance with the invention that shows it with a combination of features from several embodiments including a Thickness 24, a Cavity 21, a Radiused Entrance 28, a Hooked Stem Clearance Slot 31, a Highball Glass Recess 32, and an Upper Cavity 29. This embodiment shows that a plurality of features can be combined in a single embodiment.

REFERENCE NUMERALS

20 Stem Clearance Slot
21 Cavity
22 Top Surface
23 Bottom Surface
24 Thickness
25 Wide Stem Clearance Slot
26 Stemware
27 Sculpted Cavity
28 Radiused Entrance
29 Upper Cavity
30 Curved Stem Clearance Slot
31 Hooked Stem Clearance Slot
32 Highball Glass Recess
33 Phone/Book Slot
34 Solid Bottom
35 Feet
36 Front Face

ADVANTAGES

From the descriptions above a number of advantages of some of the embodiments shown become evident:

(a) The device is simple to use and intuitive, especially with a cavity shape that reflects the shape of the base of stemware.

(b) Said device accounts for the large variability in stemware dimensions.

(c) Said device does not go onto or attach to stemware in any way. It can be non-contacting until stemware begins to tilt. Once the stemware is acted on by a sideways force the device provides downward force onto the base of said stemware which prevents said stemware from tipping or falling over.

(d) Said device can perform multiple other functions while acting as a stemware restraint. It can hold electronics, tabletop accessories, etc.

(e) Said device can be configured to hold multiple pieces of stemware.

(f) Said device can also have cavities or protrusions on the top surface to act as a coaster and restraint for other types of glassware such as highball glasses, coffee cups, beer glasses, etc.

(g) The stem clearance slot/cavity combination in the device can be modified to provide varying levels of restraint depending upon the customer's requirements.

(h) Exterior dimensions and/or device weight can be modified to provide increased resistance to tipping if required.

(i) Said device is a unitary structure that can be made using numerous materials including but not limited to glass, plastic, metal, stone, ceramic, concrete, resin, wood, etc.

CONCLUSION, RAMIFICATIONS AND SCOPE

Thus the reader will see that the above embodiments describe a Stemware Restraining device that provides a better solution than previous devices in numerous ways. It can be non-contacting to the stemware until the stemware tips, it allows for variability in stemware dimensions, it can perform additional tabletop duties such as holding additional items or electronics, and it can be made out of numerous materials. It eliminates the need for stem supports entirely thereby decreasing the stresses on the stem and reducing the likelihood of glass breakage. Because it can have a large footprint the top surface can also be used for additional duties such as acting as a coaster and restraint for other types of glassware. Being a tabletop device it can also be used as a weight to hold down napkins, placemats, menus, etc. The exterior dimensions and details can be modified to enable said device to exhibit improved performance for secondary functions such as those described above. Said device can also be configured to hold multiple pieces of stemware in one device and it can be designed so that multiple devices are stackable/nestable for storage and transportation.

The descriptions above contain numerous specifics but should not be construed as limiting the scope of these embodiments, they simply provide examples of some of the many possible configurations of the device. External shape, slot and cavity dimensions and configurations, external attachments, and internal electronics can all be modified to suit a specific customer's requirements.

Thus the scope of the embodiments should be determined by the appended claims and their equivalents rather than the examples given.

What is claimed is:

1. A device for preventing stemware from tipping or falling over the device comprising:

a single unitary structure comprising;

a substantially block-shaped body;

at least one stem clearance slot;

a first recess or pocket;

a highball recess;

wherein said unitary structure is configured to be rested on a surface or configured to be attached to said surface, said block-shaped body including a top surface, a bottom surface, a predetermined thickness and a front surface;

wherein said stem clearance slot is located in said top surface in communication with at least one cavity below said stem clearance slot, said at least one cavity being wider than said stem clearance slot and shaped such that said stem clearance slot and said at least one cavity in combination are configured to receive a base and stem of a piece of the stemware either partially or fully into said single unitary structure, said at least one cavity and stem clearance slot are configured to conform to the shape of the base and stem of the piece of said stemware, said stem clearance slot is configured to be wider than the diameter of the stem of the piece of said stemware and narrower than the base of said stemware and said at least one cavity is configured to be wider than the base of the piece of said stemware, said clearance slot being non-linear along a horizontal centerline axis, said stem clearance slot comprising at least a first part and a second part, wherein said second part is offset from said horizontal centerline axis and said first part to define a bend, hook, or kink along said horizontal centerline axis;

wherein said highball recess is defined in said top surface and configured to receive a highball stemware;

wherein said top surface further comprising a second recess sized to hold tabletop accessories;

wherein said stem clearance slot and said at least one cavity in combination further defines a tapered entry opening on said front surface said tapered entry opening having a wide portion and a narrow portion, said wide portion is provided adjacent to said bottom surface, wherein said narrow portion is provided adjacent to said top surface.

2. The device of claim 1 wherein said tapered entry opening has a radiused entry.

3. The device in claim 1 wherein said at least one stem clearance slot and said at least one cavity comprises a plurality of slots and cavities in combinations distributed along a perimeter of said device respectively.

* * * * *